United States Patent [19]

Saunders

[11] 4,360,115

[45] Nov. 23, 1982

[54] SECTIONAL MULTI-PURPOSE CARGO CONTAINER

[76] Inventor: George D. Saunders, P.O. Box 70026, Ambassador Station, Los Angeles, Calif. 90070

[21] Appl. No.: 162,496

[22] Filed: Jun. 24, 1980

Related U.S. Application Data

[60] Continuation of Ser. No. 885,017, Mar. 9, 1978, Pat. No. 4,209,887, which is a division of Ser. No. 771,113, Feb. 23, 1977, Pat. No. 4,144,984.

[51] Int. Cl.[3] ..... B65D 21/02; B65D 88/12

[52] U.S. Cl. ..... 220/1.5; 220/4 E

[58] Field of Search ..... 220/1.5, 4 B, 4 E, 325

[56] References Cited

U.S. PATENT DOCUMENTS

| | | | |
|---|---|---|---|
| 1,755,725 | 4/1930 | Clark | 220/4 C |
| 2,521,088 | 9/1950 | Phelps | 220/1.5 |
| 3,015,407 | 1/1962 | Fesmire | 220/1.5 |
| 3,386,600 | 6/1968 | Betjemann | 220/1.5 |
| 3,691,595 | 9/1972 | Backleman | 220/1.5 |
| 3,858,752 | 1/1975 | Marvin | 220/4 E |
| 3,922,542 | 1/1960 | Barr | 220/325 |

*Primary Examiner*—George E. Lowrance
*Attorney, Agent, or Firm*—Penrose Lucas Albright

[57] ABSTRACT

A multi-purpose cargo shipping container having provision for optional individual unit use or plural interlocked use. On the one hand the individual unit may be utilized for carrying relatively high density cargo, while on the other, a pair of interlocked units forming a container may carry low package density cargo. The units are modular to permit more efficient utilization of the cargo stowing area in ships, rail cars and motor carriers.

14 Claims, 17 Drawing Figures

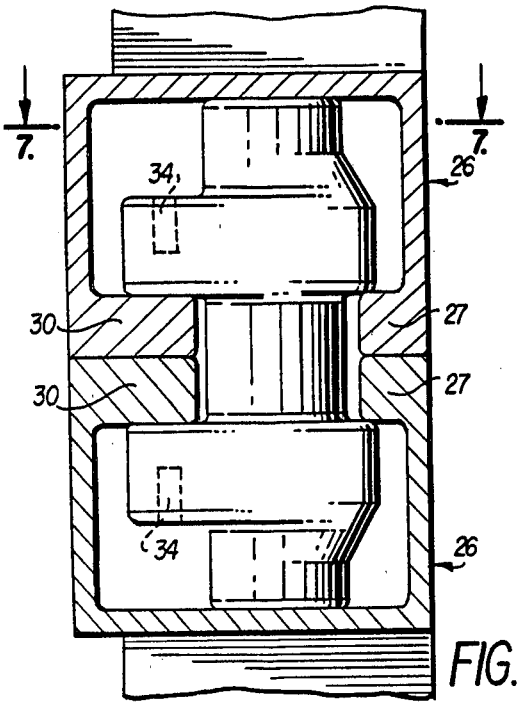
FIG. 4
FIG. 5
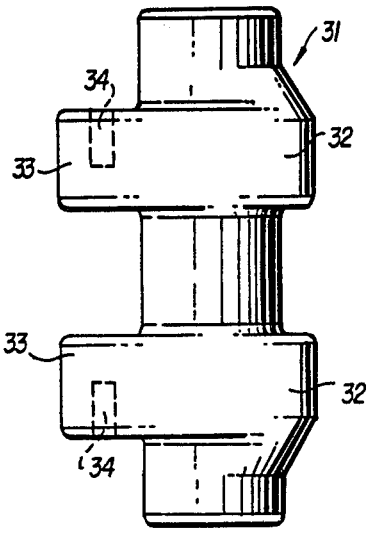
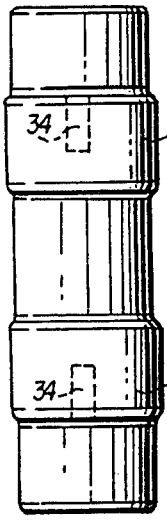
FIG. 6
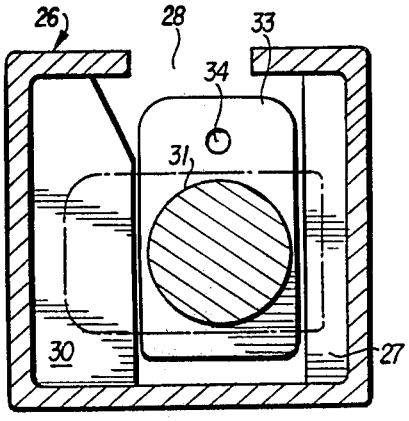
FIG. 7
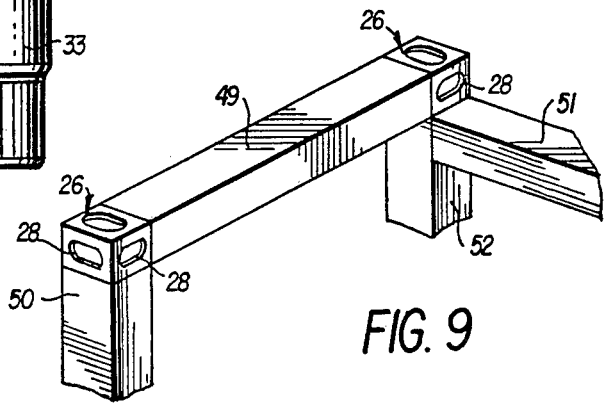
FIG. 9

SECTIONAL MULTI-PURPOSE CARGO CONTAINER

RELATED APPLICATION

This is a continuous application of application Ser. No. 885,017 filed Mar. 9, 1978, issuing as U.S. Pat. No. 4,209,887 of July, 1980, which is a division of application Ser. No. 771,113, filed Feb. 23, 1977, U.S. Pat. No. 4,144,984, of Mar. 20, 1979.

BACKGROUND OF THE INVENTION

This invention relates to the art of containerized transportation of bulk or manufactured cargo wherein efficient loading and unloading, as well as effective protection, of the cargo being handled is essential.

A primary asset of containerization of cargos is resulting facilitation in cargo handling. Containers are thus utilized interchangeably for land and ocean transportation and, on land, by rail or truck. Containers generally are of standard modular dimensions and cargos of high and low density alike are frequently containerized in the same sized full height dry freight container irrespective of the nature of the commodity or the economic justification. In certain trading patterns, low package density cargo is frequently predominant in one direction whereas high package density cargo comprises the majority of volume in the other or opposite direction. Sometimes containers move whereby they are filled in one direction and returned in an empty condition. Thus the over-standardization of cargo containers has led, at least in part, to a lack of their adaptability for various trade conditions and routes. As the following described prior art will indicate, these problems have been long known in the industry and the approach to solution is generally directed to providing containers in sections which nest together for empty return—usually for specialized one-way cargos only—and to containers which are expansible by one means or another.

DESCRIPTION OF THE PRIOR ART

The patent to Sweack, U.S. Pat. No. 3,113,690 issued Dec. 10, 1963 discloses a container which comprises upper and lower units which may be assembled and locked together or dissambled and internested for compact shipment when empty. The patent to Fitch, U.S. Pat. No. 2,071,334, granted Feb. 23, 1937, discloses upper and lower elements which, when interlocked, provide a cargo enclosing container. The patent to Butts et al, U.S. Pat. No. 1,926,432 of Sept. 12, 1933, discloses a series of stackable containers with releasable load-carrying floor members for carrying bricks and the like. The patent to Gould et al, U.S. Pat. No. 2,708,509, issued May 17, 1955 discloses a container for the rotor blades of a helicopter, which comprises similar upper and lower shells.

From the foregoing, it should be recognized that a need has long existed for containers which are practical and adaptable for utilization with different types of cargo—primarily high density and low density cargos.

SUMMARY OF THE INVENTION

The concept of the instant invention involves the provision of two containers of one-half the height of a normal container, each container being sufficiently structurally strong whereby it may carry a relatively heavy cargo. Such containers may be placed together with one constituting the top portion of a composite container and the other the bottom thereof wherein such a container may be used in trade routes for moving manufactured goods or finished products from an industralized country. On the return trip, the containers may be utilized separately for carrying bulk raw materials or semi-finished goods. In other words, two containers are connected together to carry machinery and the like which has a comparatively low package density in one direction and are separated to carry high package density goods in the other direction.

It is an object of this invention to provide a plurality of like open container units each having several sides which are of sufficient strength to bear the stresses of heavy cargos.

It is a further object of this invention to provide a pair of like open units which may be disposed with their open sides facing and so interlocked to form a closed dry freight container.

Another object of this invention is the provision of a modular open container unit having several sides which are of sufficient strength to carry heavy cargos, and having further load bearing means of skeletonized character and of the same modular dimensions, for attachment thereto.

A still further object of this invention is the provision of a modular open container unit having several sides of sufficient strength to carry heavy cargos and a load bearing floor may be provided with fork lift pockets.

Containers of the prior art generally fail to provide the versatility of my device in that they do not disclose a two unit container, both of which units are the same and both of which may be individually used as a cargo holder. Also commercially available devices in the container transport field do not involve the concept of a plurality of like two-part cargo carrying containers capable of being transported in stacked or superposed relation.

Other objects, adaptabilities and capabilities will appear as the description progresses, reference being had to the accompanying drawings, in which:

BRIEF DESCRIPTION OF THE DRAWINGS

FIG. 4 is an elevation (or side) showing the locking device holding a corner of two units in assembled relation;

FIG. 5 is a side view of a locking device;

FIG. 6 is an end view of a locking device;

FIG. 7 is a sectional plan view illustrating the locking device in locked and unlocked positions taken on section line 7—7 of FIG. 4;

FIG. 9 is an enlarged detail of the structure of FIG. 8;

DESCRIPTION OF THE PREFERRED EMBODIMENTS

Figure 2:
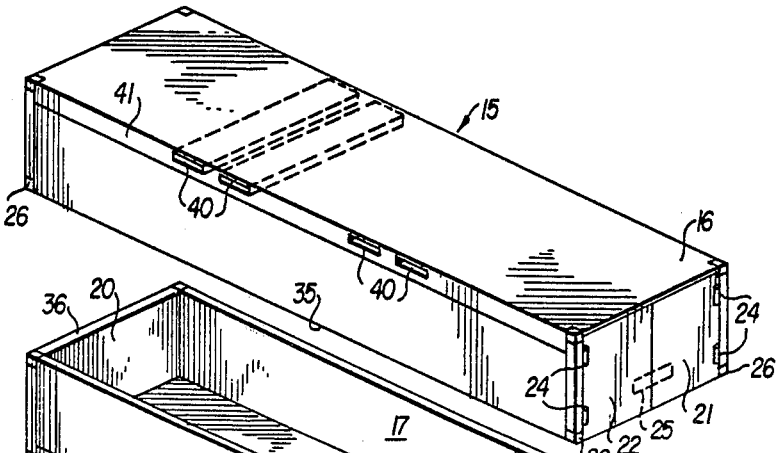
FIG. 2 is a perspective view of a similar container unit in inverted position.
Figure 1:
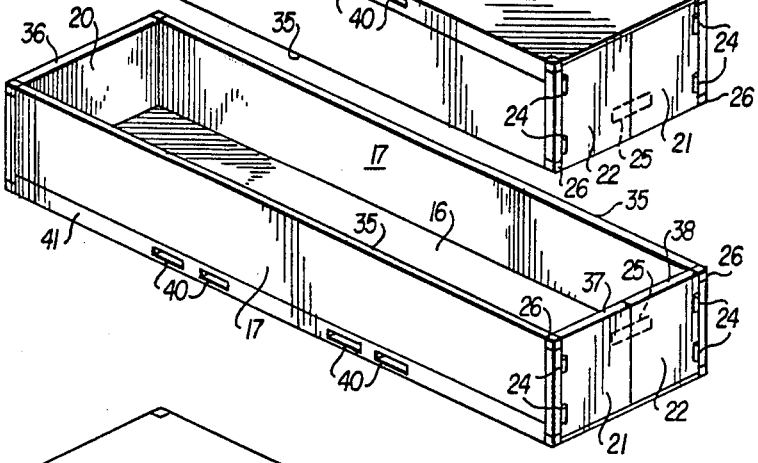
FIG. 1 is a perspective view of an open container unit disposed to receive a cargo.

Considering FIGS. 1 and 2, each unit 15 comprises a load bearing floor 16, parallel opposed longitudinal side walls 17, and end wall 20 and a parallel end wall comprised of parts 21 and 22. End wall 20 is fixed to sides 17, and end parts 21 and 22 comprise a pair of doors hinged as at hinge members 24 to the sides 17 and interiorly rigidly locked together by latch 25 to each other. Each unit 15 is dimensionally the same and is of a volume representing one-half the volume of a closed conventional container of the type involved. A closed container is obtained by bringing together two units 15 in a manner whereby the two respective open tops face each other. As may be seen from FIG. 3,the inverted unit 15 illustrated in FIG. 2 has been placed on top of the like unit 15 illustrated in FIG. 1. The two units 15 being secured to each other by locking devices which will presently be described.

Adjacent each corner of each unit, along the open face thereof, a hollow casting 26 is provided in a fixed relation to the corner unit 15. The casting is provided with inwardly projecting spaced shoulder means 27 and 34, extending towards each other, as shown in FIG. 4. A movable locking device 31, shown in FIG. 5, is inserted in the space between the shoulder means 27 and 30 and manipulated in a manner to be described. Locking device 31 is provided with symmetrically arranged pairs of dogs 32 and 33. Dogs 33 are provided with apertures 34. When it is desired to interlock two units, the first unit is disposed as is shown in FIG. 1. After the cargo has been placed therein, a locking device 31 is manually positioned with dog 32 and a dog 33 in the space between the shoulders 27 and 30 of the casting 26. A locking device 31 is similarly positioned in each corner of unit 15. It will be noted that the upper dogs 32 and 33 at each corner extend upwardly above the rim of the unit and that the apertures 34 are accessible from the exterior. The second unit is the placed upon the first unit with the respective castings 26 coinciding with those of the first unit and with the upper dogs 32 and 33 disposed in the space between the shoulders 27 and 30 of the castings of the second unit. A two-pronged tool, as shown in FIGS. 10–13, is then used to engage simultaneously the upper and lower apertures 34 to rotate the locking device 31 inwardly about its vertical axis, substantially ninety degrees from the position shown in solid lines to that shown in dot-dash lines in FIG. 7. Upon such rotation, dogs 32 and 33 override shoulders 27 and 30, as shown in FIGS. 4 and 7, thereby effectively locking the units together to form a closed dry cargo container suitable for the transport of goods requiring protection from the elements and security from external hazards. Each locking device at each corner 26 is similarly manipulated. To release the units the locking device is manipulated in a reverse direction.

To ensure that units 15 are of sufficient strength to bear the load of the contained cargo, as well as that of other units stacked thereon, rails 35, 36, 37 and 38 are provided along the periphery adjacent the open face of the sides 17 and ends 21 and 22. The rails are of sufficient strength to assure the proper support of the cargo contained in the unit as well as sustaining the weight of other containers. It should be noted that the length, width and depth dimensions of the container are preferably functions of each other, i.e., they are of uniform multiples of each other to facilitate varied stacking thereby more efficiently utilizing available storage space. The deck of floor 16 of each unit is preferably of steel plate or the like. To facilitate handling of the units, fork lift pockets 40 may be provided in longitudinal beams 4 included in sides 17. Alternative conventional means may be provided for handling the units or containers.

Figure 8:
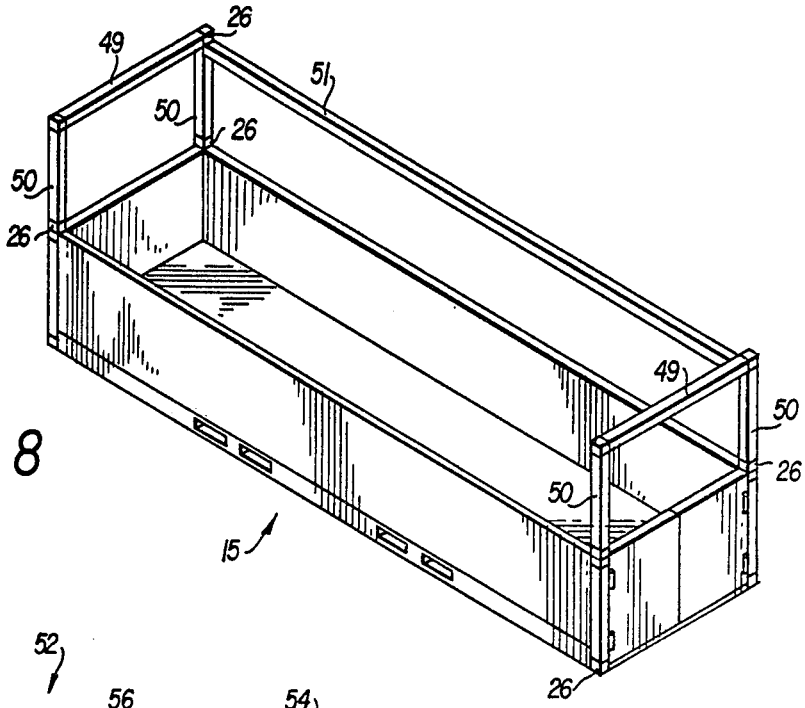
FIG. 8 is an illustration of a modified form of the invention of generally skeletonized character.
Figure 10:
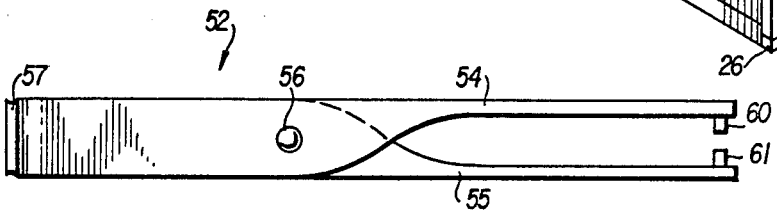
FIG. 10 is a side elevational view of a hand tool for securing the associated units together.
Figure 11:
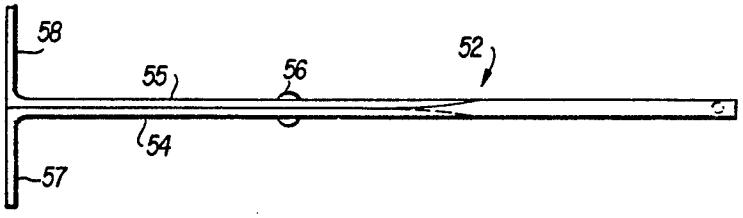
FIG. 11 is a plan view of the device shown in FIG. 10.
Figure 12:
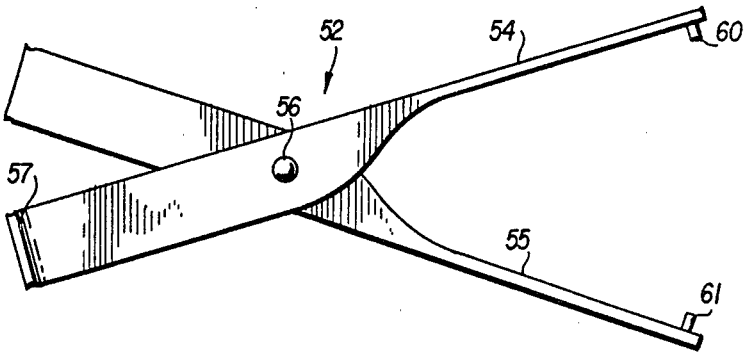
FIG. 12 is a side view of the tool shown in FIG. 10 illustrated in opened position.
Figure 13:
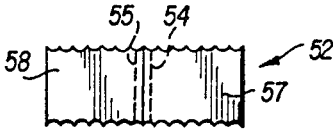
FIG. 13 shows an end view of such tool.

FIGS. 8 and 9 illustrate the alternative arrangement for transportation of bulky cargo. In some instances, where the cargo necessitates the use of a container of the volumne encompassed by the pair of units shown in FIG. 3, but where protection from the elements is not a factor, the arrangement illustrated in these figures serves very satisfactorily. A skeleton unit comprising transverse end members 49, vertical member 50 and a single longitudinal member 51 provide the structures for this arrangement.

Figure 3:
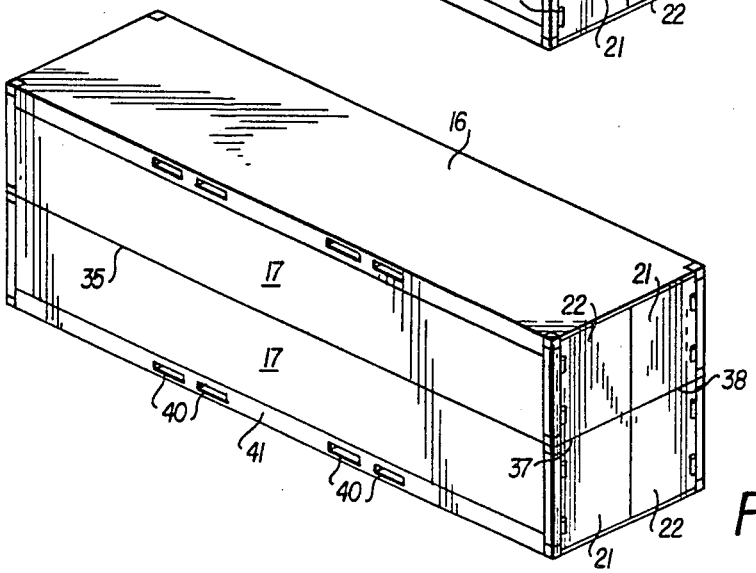
FIG. 3 is a perspective view illustrating the relation of the container units of FIGS. 1 and 2 when in interlocked position.

The basic purpose of end members 49 is to protect the cargo in units 15 from being crushed by the container next above when a plurality of containers are located in the cellular slots of a container ship or when double stacked on the deck of a ship or stacked on shore. Each end member is of the same width as the unit 15 and preferably of a height so that, when added to the height of unit 15, the combined height is equal to the height of a standard unit or of the combined units 15 and 16 as shown in FIG. 3. It will be noted that the end member 49 is fitted with corner cuboid castings 26. Such castings 26 on the ends of vertical members 50 accommodate the various mechanical lifting devices which are used for moving containers on and off of ships, rail cars and traction trailers. The bottom of each vertical member 50 is also fitted with a corner cuboid casting 26 as illustrated and is locked to the unit of 15 in the same manner as illustrated for units 15 and 16 in FIGS. 4–7.

The detachable upper frame rail member 51 is connected by threaded bolts, or other appropriate connective means whereby it is readily removable, just below each corner cuboid casting 26 to vertical members 50. Although only shown as so attached on one side in FIG. 3, preferably two such rail members are utilized for both the starboard and port sides of the container in the same relative positions. The purpose of such rail members is to compensate for forces of compression and tension which are applied to units 15 and vertical members 50 and, in addition, to provide structural support for tarpaulins or other protective component parts.

Referring now to FIGS. 10–13, a band tool for use in manipulating the locking device 31 is illustrated. This tool, designated generally by reference numeral 53, comprises a pair of supporting members 54 and 55 which are joined by a rivet 56 so as to be rotatable relative to each other in a scissor-like movement. Each supporting member 54 and 55 terminates in its rear in a handle portion 57 and 58 respective which extends normally from its corresponding supporting member and it is serrated along both upper and lower edges to facilitate manual gripping. At the other end of each supporting member 54 and 55 are a pair of protrusions 60 and 61 respectively which are rigidly secured to their corresponding supporting member and adapted to be received in apertures 34.

The tools 52 are utilized for insertion of the ends of members 54 and 55 into the openings 28 of the cuboid castings 26, one in each opening and with protrusions 60 and 61 being placed in apertures 34, locking device 31 may be manipulated between the positions as shown in continuous and broken lines in FIG. 7 whereby engaging castings 26 together with connected units or other members may be locked into or unlocked from a secured position.

In addition to the connections provided by the casting 26 and locking device 31, it is often desirable that the rails 35 and 36 be rigidly connected together. Such connections contribute to the stiffness of the integrated container, contribute to the water tightness of the combined units, and provide a further interconnection of the units should locking device 31 fail for any reason.

Figure 14:
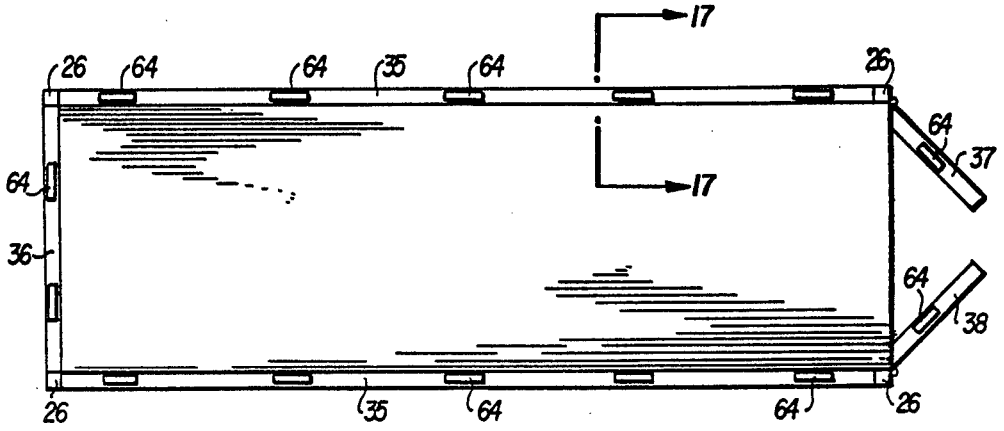
FIG. 14 is a plan view of the side and end rails viewed from above a bottom unit which illustrates means for securing the rails of upper and lower units together.
Figure 15:
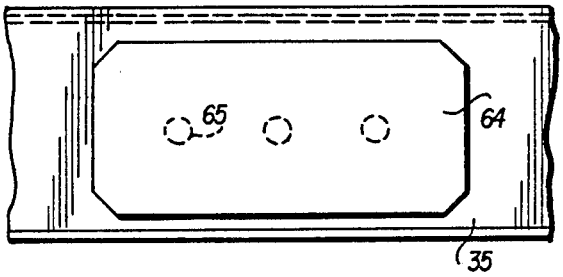
FIG. 15 is a detail plan view of one of the securing devices shown in FIG. 14.
Figure 16:
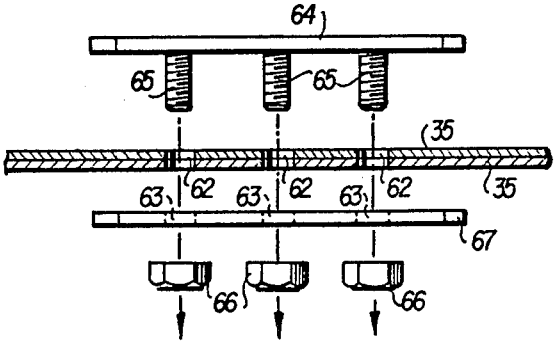
FIG. 16 is an exploded elevational view of the securing device illustrated in FIG. 15.
Figure 17:
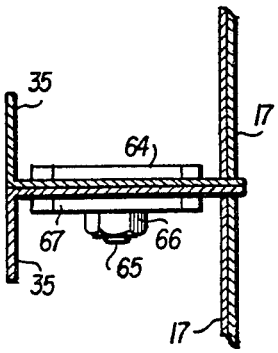
FIG. 17 is a sectional view of the securing device taken on lines 17—17 of FIG. 14.

FIG. 14 shows the rails 35, 36, 37 and 38 in a position as they are seen if looking downwardly from the interior of the combined units shown in FIG. 3. It will thus be noted that a plurality of locking plates 64 are provided along the rails 35, and at least two locking plates 64 are provided on rail 36. Finally, on rails 37 and 38 for the doors, at least one locking device 64 is provided for each. Each locking plate 64 has three studs 65 welded thereto which are received through matched openings 62 in the contacting rails 35 of the combined upper and lower units and further through also matched openings 63 in a spacer plate 67, each of the studs 65 thereafter receiving a nut 66 whereby each securing device is firmly secured in place as shown in FIG. 17. In the door or wall parts 21 and 22, the upper rail 37 bears on the lower rail 38 and vice versa. Such rails are secured together in the same manner by locking plate 64, stud 65, through matching openings 62 and 63, spacer plate 67 and finally by nuts 66.

The use of three or more studs 65 on a locking plate 64 is preferred inasmuch as it contributes substantially to the stiffening of the connected rails 35. However, it will be appreciated that conventional individual bolts received through the matched openings 62 may be employed if desired. Alternative means may be provided for interconnecting of the two units which may include, but not be limited to, modified forms of locking plates and spacer plates.

It will thus be appreciated that there has been provided an open cargo carrying unit of one-half the usual size of a cargo carrying container with locking means permitting two units to be united to form a closed container. The container is further capable of sustaining the load of several other cargo laden containers placed thereupon. The closed container is most effectively usable for moving manufactured goods or finished products where protection is essential. On the other hand, a single cargo unit in conjunction with a skeletonized unit is most effective in the transport of high density or bulk cargo, yet it continues to afford the advantages of the modular container.

Although I have described the preferred embodiments of my invention, it is to be understood that it is capable of other adaptations and modifications within the scope of the appended claims.

Having thus described my invention and what I claim as new and desire to secure by Letters Patent of the United States is:

1. A shipping container of the type described comprising an open top unit and an open bottom skeletonized extension unit; said open top unit comprising parallel opposed longitudinal walls, parallel opposed end walls interconnecting said longitudinal walls, a rectangular floor member fixed to said walls and a vertical structural post at each vertical corner, each said structural post having a pair of hollow corner fittings rigidly attached thereto at its upper and lower aspects; said skeletonized unit comprising a pair of end post members and a longitudinal member detachably connecting said end post members, each said end post member being coextensive with a respective said vertical structural post and extending above a respective said end wall of said open top unit, said longitudinal member being spaced higher than and parallel to the tops of said longitudinal walls, said end post members each having two spaced apart further hollow corner fittings rigidly attached thereto on its upper aspect and on its lower aspect, and lock means releasable connecting said open top unit and said skeletonized unit, said lock means comprising means rigidly connecting each said fitting on an upper aspect of each said vertical structural post with a corresponding further fitting at the lower aspect of a respective end post member whereby said skeletonized unit is rigidly connected to said open top unit to form a composite container which is adapted to be lifted as a unit through said further corner fittings at the upper aspects of said end post members.

2. A structure as defined in claim 1, wherein said lock means is removably and releasably connected to said vertical structural parts of said open top unit and to said end members of said skeletonized unit.

3. A structure as defined in claim 1, wherein said vertical structural posts of said open top unit are load bearing means, and wherein the end members of said skeletonized unit are load bearing means and are so constructed and arranged that the structure has length, width and height dimensions corresponding to that of a standardized container and like said shipping containers may be superimposed thereon.

4. A shipping container of the type described comprising: a pair of substantially identical open top units; each unit comprising a framework and wall means rigidly attached to the exterior of said framework, said wall means including parallel opposed longitudinal wall means, parallel opposed end wall means interconnecting said longitudinal wall means, and a rectangular load-supporting floor means rigidly fixed to said framework, said units arranged so one is mounted in an inverted position on the other whereby the interior spaces of both units are joined and enclosed by said wall means and said floor means; means provided in said framework for affixing said units to each other, said affixing means comprising readily removable locking means in the interior of each unit adjacent the places said longitudinal wall means of each unit are joined; said locking means of one said unit engaging the locking means of the other said unit and maintaining said framework of each unit in a rigid relationship with the other, said locking means in said units being separable only from the interior of the container whereby said units can be disconnected only by one having access to the interior of the container.

5. A structure as defined in claim 4, wherein said framework of each unit is juxtaposed with the other and includes beams in one said unit which are adjacent and directly contacting beams in the framework of the other said unit, said adjacent beams having a plurality of aligned openings, said locking means comprises a plate, a plurality of studs affixed to said plate, said studs each adapted to be received in one of said aligned openings, a further plate with further openings adapted to be received by said studs, and nuts received on said studs bearing against said further plate whereby said frameworks are firmly and rigidly secured together in an essentially continuous contact.

6. Structure as defined in claim 4, wherein each said unit includes corner fitting means in its said framework accommodating hardware for lifting each said unit separately or the container as a whole in loaded or unloaded conditions.

7. Structure as defined in claim 4 wherein at least one of said wall means includes access means.

8. An assembly comprising an intermodal shipping container having a framework supporting a floor and sides, an open top and corner fitting means at its corners which are rigidly connected to said framework and are of a type adapted to accommodate various mechanical devices for lifting and moving standard intermodal shipping containers of like dimensions, said container being combined with a skeletal structure consisting essentially of first and second frame extension structures attached to the transverse sides of said container, said structure comprising a pair of parallel vertical legs, further corner fitting means structurally and functionally similar to said first-mentioned corner fitting means rigidly connected to the upper and lower aspects of each said vertical leg, a horizontal beam rigidly connecting said further corner fitting means at the upper aspects of each said vertical leg, means for connecting each said end frame structure to a respective transverse side of said container comprising a locking device fitted jointly and mutually into said further corner fitting means at the lower aspect of each frame extension structure's lower leg and an upper said corner fitting means of said container whereby said horizontal beam of each said frame extension structure is parallel to and maintained in a rigid spaced relationship over a respective transverse side of said container, at least one detachable upper frame longitudinal rail connected across said first and second frame extension structures, each said rail being detachably connected to each said frame extension structure, said four further corner fittings on the upper aspects of said legs adapted to receive various mechanical devices for lifting and moving the assembly as a cargo carrying unit either loaded or unloaded for intermodal shipping.

9. An assembly in accordance with claim 8, wherein each said locking device is virtually entirely within the interiors of said corner fitting means and said connected further corner fitting means.

10. An assembly in accordance with claim 8 wherein each said locking device is separable from its respective end frame extension structure upon being disengaged from said container.

11. An assembly in accordance with claim 8, wherein said end frame extension structures have sufficient load bearing capacity whereby a plurality of like loaded assemblies may be stacked upon each other.

12. An assembly in accordance with claim 11 wherein said rail is so constructed and arranged to withstand forces of compression and tension when the assembly is lifted, moved or bearing like loaded assemblies stacked thereon.

13. An assembly in accordance with claim 8 wherein said rail is adapted to support protective means.

14. An assembly in accordance with claim 13 wherein said protective means comprises a tarpaulin roof for said shipping container.

* * * * *